United States Patent [19]

Johnson

[11] Patent Number: 4,596,289

[45] Date of Patent: Jun. 24, 1986

[54] QUICK RESPONSE AUTOMATIC FIRE SPRINKLER HEAD

[76] Inventor: Kimball W. Johnson, 36 Rocky Hill Rd., Oxford, Mass. 01540

[21] Appl. No.: 732,677

[22] Filed: May 10, 1985

[51] Int. Cl.[4] ..... A62C 37/08

[52] U.S. Cl. ..... 169/37; 169/40

[58] Field of Search ..... 169/37, 40, 39, 42, 169/38, 41, 90

[56] References Cited

U.S. PATENT DOCUMENTS

| | | | |
|---|---|---|---|
| 2,871,953 | 2/1959 | Bray | 169/37 |
| 3,195,647 | 7/1965 | Campbell et al. | 169/37 X |
| 3,633,676 | 1/1972 | Gloeckler | 169/40 |
| 4,405,018 | 9/1983 | Fischer | 169/37 |
| 4,417,626 | 11/1983 | Hansen | 169/37 |

*Primary Examiner*—Jeffrey V. Nase
*Assistant Examiner*—L. E. Williams
*Attorney, Agent, or Firm*—Herbert L. Gatewood

[57] ABSTRACT

Fire sprinkler head suitable for mounting in a concealed location in the ceiling in a residential dwelling which provides quick and automatic response in the event of a fire. The valve assembly in the sprinkler head is biased to the open mode and is maintained in the closed mode against a positive force tending to move the valve assembly to the open mode by a valve closure which is separable into its two sections at the onset of a fire and the attainment of a predetermined ambient temperature surrounding the valve closure. The two sections of the valve closure are maintained intact as a unit until the temperature of the fire melts a heat fusible alloy composition.

21 Claims, 11 Drawing Figures

QUICK RESPONSE AUTOMATIC FIRE SPRINKLER HEAD

BACKGROUND OF THE INVENTION (1) Field of the Invention

This invention relates, in general, to fire extinguishing sprinkler heads, and, in particular, to a concealed, automatic sprinkler head suitable for use in residential dwellings.

(2) Description of the Prior Art

Sprinkler systems are used extensively to provide automatic fire protection for residential, commercial and public buildings. Nevertheless, for a sprinkler head to qualify as suitable for use in a residential sprinkler system, the sprinkler head must pass many tests, several of which go beyond those normally used for ordinary commercial/industrial type sprinkler heads. The two greatest distinctions between ordinary and residential type sprinkler heads are the operating speed and specially designed water spray patterns that fire tests have revealed are necessary to combat or extinguish a fire in typical residences. The residential type sprinkler head must operate at a faster speed than the ordinary commercial/industrial sprinkler head, the faster the better, as the protection of human life is involved. Thus, there is a keen interest in providing residential sprinkler heads with even shorter times to become operable.

The primary purpose of a fire sprinkler system is to extinguish or, at least, contain a fire prior to the arrival of fire fighters and fire fighting apparatus. The theory behind the use of fire sprinkler systems is that, by preventing a fire from getting out of control, property damage is minimized and, even more importantly, in the case of residential sprinklers, lives can be saved.

At one time, the greatest danger from a fire in the home was in being trapped by flames and burned or suffocated by smoke. However, in more recent years, residential dwellings are being furnished with, or contain furnishings and fixtures which, because they are made of, or contain synthetic materials, give off highly toxic fumes when ignited or heated to a sufficient degree. Thus, it has become increasingly clear that many fire fatalities result from inhaling toxic fumes produced by the fire rather than from the fire itself or smoke produced thereby.

In many cases, fire victims are overcome by these toxic fumes and die in their sleep long before the fire becomes intense enough to be noticed by inhabitants of the dwelling or by neighbors. The recognition of this problem has led to the extensive use of heat and smoke alarms for alerting inhabitants of a dwelling that a fire is in progress. The early alert which is provided by these alarm systems enables the inhabitants to leave the dwelling while it is still safe to do so.

The use of smoke and heat detectors, however, does not diminish the importance of a fire sprinkler system. Although individual safety is of prime importance, the loss of one's home and worldly possessions, represents a tragic event. Also, a fire which is out of control represents, in some cases, a potential threat in spreading to adjacent property, thereby endangering the lives of other individuals. A fire out of control also represents a danger to fire fighters and to individuals who may not be able to leave a residential dwelling quickly, or perhaps not even at all, such as might be the case with small children, infants, the ill, handicapped persons, or elderly residents of a nursing home.

The automatic fire sprinkler head, whether of the commercial/industrial type or one for residential dwellings comprises, in general, an elongated body member which is open at one end, and connected to a water line, and is closed at the other end by a valve mechanism which operates to open in response to a fire. The valve mechanism ordinarily is maintained in the closed position, in part, by a low melting point fusible composition, until the occurrence of a fire. In such an occurrence, when the ambient temperature is increased to a predetermined level, the fusible composition melts, resulting in the valve mechanism operating to open from the closed position, and allowing the discharge of the fire extinguishing water.

In residential dwellings, and sometimes even in commercial buildings, it is most desirable to utilize a sprinkler head that can be located almost entirely above the ceiling so as to be hidden, or concealed, from view, leaving the attractiveness of a room relatively unspoiled. With some such sprinkler heads, the sprinkler head is concealed within the ceiling by a decorative plate which is mounted flush against the ceiling, the decorative plate itself being a part of the bottom of the sprinkler head. As described in U.S. Pat. Nos. 3,633,676 and 3,714,989, for example, the decorative plate is attached to the sprinkler head by a fusible material, and when the fusible material melts, the decorative plate is released to expose the fusible element of the lever assembly, which on melting releases the lever assembly to open the valve so that the fire extinguishing fluid can be discharged. Sprinkler heads of this type, as will be appreciated, have a disadvantage in that two separate fusible release mechanisms are required, one to release the decorative plate to expose the fusible element of the lever assembly, and the second to release the lever assembly to open the valve.

In U.S. Pat. No. 4,015,665, there is disclosed a further concealed, automatic sprinkler head, in which the flush-mounted decorative plate, which is formed integrally with the latch bar of the sprinkler head, is provided with a series of openings. This, according to the patentee provides for improved heat transfer to the fusible element, resulting in a faster response rate in releasing the valve, to allow discharge of the fire extinguishing liquid. As is described in U.S. Pat. No. 4,015,665, the conical-shaped valve therein is connected to the ends of a pair of guide rods which are slidably mounted in holes in the sprinkler body. The valve assembly is normally retained in the closed position by a compression screw, which compresses a compression spring which exerts a downward force against the latch bar retaining the locking balls in place. In the event of a fire, the heat fusible material melts and the force of the compression spring, which is acting downwardly, causes release of the valve latching or locking mechanism. Thus, the force of the fire extinguishing water against the valve assembly causes it to drop whereby the outlet is opened and the fire extinguishing water is discharged against the deflector plate and onto the fire.

SUMMARY OF THE INVENTION

The invention disclosed herein, in general, is a fire sprinkler head of novel construction suitable for mounting in the ceiling in a residential dwelling and which operates automatically to release fire extinguishing water to be discharged therefrom onto a fire when a certain predetermined ambient temperature is reached. The fire sprinkler head disclosed herein can be mounted in the ceiling of a room in such a manner that it is essentially concealed from view whereby the sprinkler head can most desirably be used in residential dwellings without adversely affecting the asthetic features in the surroundings.

Quite advantageously, and this is a most important feature of the fire sprinkler head of this invention, the features of construction provide a quicker response time than have other fire sprinkler heads available heretofore, whether of the concealed or exposed type.

The fire sprinkler head of this invention is of relatively simple construction offering certain economies in manufacture. A further advantage in the sprinkler head of this invention is that it can be restored to operable condition and reused with replacement of few parts. And, this can be accomplished without removing the sprinkler head from the system.

The fire sprinkler head of the invention, in its more basic aspects, comprises an elongated body member having an inlet end to be connected to a fire extinguishing fluid line, e.g., a water line, and an outlet end for discharge of the fire extinguishing fluid onto a fire, a central passageway in said body member connecting said inlet end to said outlet end, an outwardly extending flange at said inlet end integral with and surrounding the said body member, two spaced-apart openings being provided in said flange located on an imaginary line and on opposite sides of said body member, an elongated housing for said elongated body member open at the bottom end thereof and provided with a horizontally disposed, planar top closure at the top end, a centrally located opening in said top closure through which said inlet end of said body member extends, a member surrounding said elongated body member having an inwardly extending flange extending around the outer periphery thereof and of somewhat greater dimension than said opening in said top closure, said outwardly extending flange being in contact with and pressing against the underside of said top closure, a valve assembly comprising a horizontally disposed circular-shaped deflector plate located adjacent to and beneath said outwardly extending flange in said body member, a plurality of teeth being provided uniformly and in spaced-apart locations around the circumference of said circular-shaped deflector plate, a valve body member located centrally on and supported by said deflector plate which, when the valve assembly is in its closed position, intrudes into said outlet end, means being located on said valve body member for providing positive seal of said outlet end when the said valve assembly is in the closed position, a strut retaining member surrounding said body member and capable of movement up and down along the length of said body member, two spaced-apart vertically disposed struts connected to said member at their top ends on a line that coincides with the line on which said two spaced-apart openings are located, said struts each extending through respective said spaced-apart openings and being connected at their bottom ends to said deflector plate and each extending a predetermined distance there beyond, a compressible member surrounding said elongated body member and being located between said outwardly extending flange on said body surrounding member and said strut retaining member, and a valve closure means located in the open bottom end of said housing for maintaining the valve assembly in the closed position until the onset of a fire comprising a horizontally disposed strut retaining member divided into two equal parts, the said strut retaining member being so oriented with respect to the imaginary line along which said spaced-apart openings in said flange are located that the dividing line of said strut retaining member is perpendicular thereto, and means responsive to heat for maintaining and securing the two equal parts of said strut retaining member intact as a unit until the onset of a fire whereby until the onset of a fire and the attainment of a predetermined ambient temperature around the said sprinkler head said compressible member is maintained in the compressed mode and the bottom extending ends of each said strut bears directly against respective halves of the said strut retaining member under a positive force.

In the most preferred aspect of the invention, the valve closure means comprises a planar, heat conductive member of predetermined lesser dimension laminated to the strut retaining member by a layer of heat fusible alloy. Thus, quite advantageously the heat conductive member not only provides that the strut retaining member will remain intact as a unit until the onset of a fire and the predetermined ambient temperature is reached but it will also provide a high degree of heat collection focused on the heat fusible alloy layer. Accordingly the alloy will melt quickly, allowing the strut retaining member to fall away from the housing in two parts, and the force of the compressible member to cause the valve assembly to move to the open position.

BRIEF DESCRIPTION OF THE DRAWING

The novel features and operation of the fire sprinkler head of the present invention will be better understood by reference to the drawing; in conjunction with reading the following specifications, in which.

DETAILED DESCRIPTION OF THE INVENTION AND THE PREFERRED EMBODIMENTS

Figure 1:
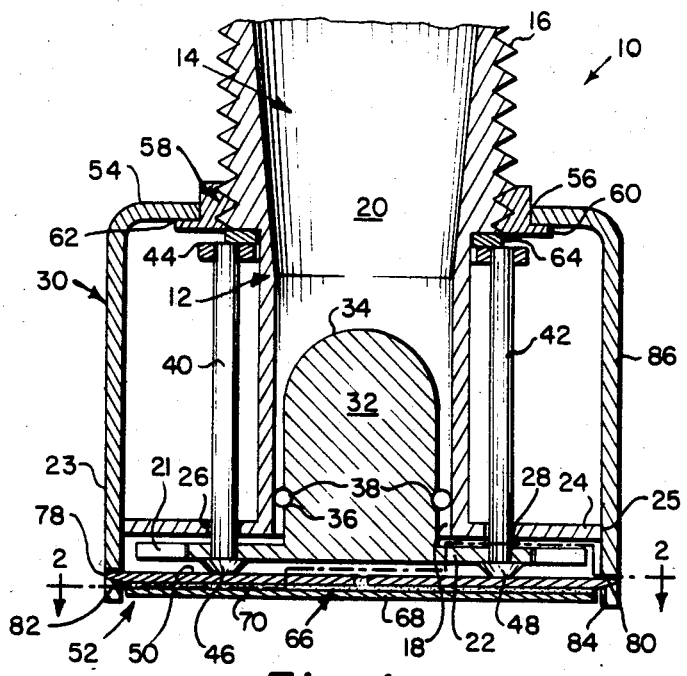
FIG. 1 is a schematic, vertical, cross-sectional view of the most preferred sprinkler head according to the invention.
Figure 2:
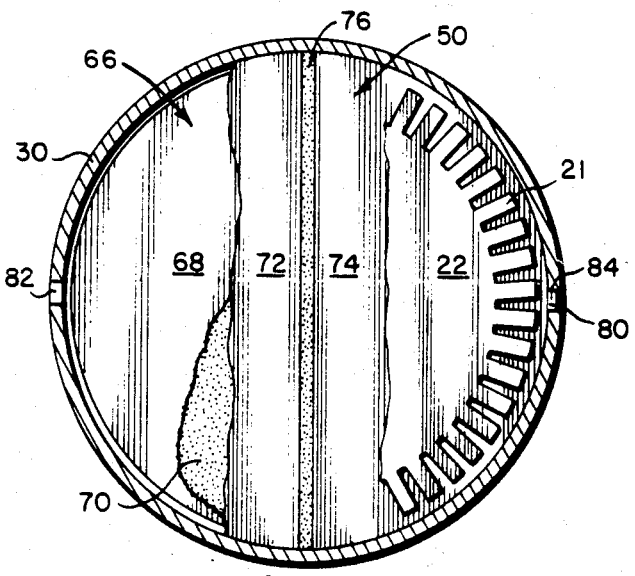
FIG. 2 is a plan view of the sprinkler head shown in FIG. 1, looking at the bottom thereof.
Figure 3:
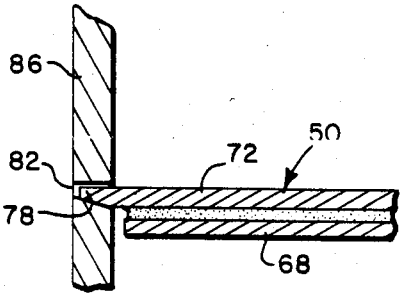
FIG. 3 is a view in part of the cross-sectional view of the fire sprinkler head shown in FIG. 1 better showing the location of the valve closure means in the bottom end of the housing.

Referring now to the drawing, there is shown in FIGS. 1-3 thereof the most preferred embodiment of a concealed type fire sprinkler head according to the invention, as denoted by reference numeral 10. Sprinkler head 10 comprises an elongated body member 12 which is provided at the upper, or inlet, end 14 thereof with external threads 16 for connection of the sprinkler head 10 to a conventional overhead fire sprinkler system through an internally threaded female socket, not shown. The elongated body member 12, as will be seen from FIG. 1, terminates at outlet end 18, and the inlet and outlet ends are connected by a centrally located passageway 20. As is shown, the inlet end of passageway 20 tapers inwardly for a predetermined distance and then passageway 20 is of cylindrical shape toward and continuing to outlet end 18. Thus, in accordance with well known properties of fluid flow, when the fire extinguishing liquid passes through passageway 20, its velocity increases because of the narrowed passageway, attendant with a somewhat decreased pressure, resulting in a highly suitable discharge flow toward and against deflector plate 22, and hence, a pattern of fire extinguishing liquid on a fire, more suitable to fires in residential dwellings. The deflector plate 22 is of conventional design, the requirements therefor being established by Underwriters Laboratories, Inc. In general, however, deflector plate 22 is provided around its outer peripheral edge with a plurality of spaced-apart teeth 21. These teeth are of uniform dimension and size and are spaced uniformly from one another. When fire extinguishing water discharges from outlet end 18 and strikes deflector plate 22, these teeth provide the desired spray pattern on the fire.

At outlet end 18, elongated body member 12 is provided with a flange 24, the purpose for which will be disclosed subsequently. Flange 24, which extends perpendicularly outwardly from body member 12, is of an annular shape and is integral with and surrounds the body member 12. Nevertheless, it will be appreciated that flange 24 need not necessarily be integral with the body member nor of annular shape. It can be separately manufactured, if desired, and subsequently permanently connected to the body member. Further, the entire periphery of the flange, while desirably circular, can be any shape desired, e.g., polygonal. This depends somewhat on the cross-sectional shape of housing 30, to be later more fully disclosed. Importantly, however, flange 24 is permanently connected at its outer peripheral edge to the inside wall of housing 30, as indicated by reference numerals 23, 25. The flange 24 is provided with two spaced-apart openings 26, 28 located on an imaginary line and on opposite sides of the body member 12, as shown.

Supported by circular shaped deflector plate 22 is valve body member 32, being located centrally thereon. As seen from FIG. 1, valve body member 32 is integral with deflector plate 22 and of solid construction; however, this need not necessarily be the case, as in disclosed hereinafter. Valve body member 32 is rounded in cross-section and of elongated shape, as seen in the drawing, and is provided with a dome-shaped end 34. Nevertheless, valve body member 32 need not terminate in a dome shaped end. The end can be planar if desired, or the valve can terminate in a cone. The major consideration is that the valve body member 32 intrude into outlet end 18 for closing off the discharge of water or other fire extinguishing fluid from sprinkler head 10, as desired. The base of the valve body member will, in any event desirably be of circular shape and provided with a groove 36 for location of a conventional O-ring 38 for providing a positive seal against water leakage. Other sealing means can, of course, be provided instead, if desired, in accordance with conventional techniques.

Extending vertically upwardly from deflector plate 22 are two spaced-apart, parallel, struts 40, 42 which terminate at their top ends in and are connected to strut directing member 44, which surrounds body member 12. This member, as shown, is of annular shape; however, it need not be of such a shape at all, unless desired. The main consideration is that strut directing member 44 be capable of up and down movement along elongated body member 12, in the operation of the valve assembly from a closed to an open position, as later more fully disclosed. As shown in FIG. 1, struts 40, 42 pass through respective openings 26, 28 in flange 24 and are connected to deflector plate 22, the bottom ends 46, 48 of which extend a predetermined distance vertically therebeyond. The bottom ends 46, 48 of struts 40, 42 are desirably conical shaped, as shown, and are in pressing contact against respective halves of strut retaining member 50, the purpose for which will be more fully disclosed hereinafter.

As seen from the drawing, elongated body member 12 and the operating parts of the valve assembly are contained from view within elongated housing 30. This housing is mountable within the ceiling of a room in such a fashion that the bottom opening 52 of the housing is flush with the ceiling whereby the aesthetic features in the surroundings are not unduly adversely affected. The top of housing 30 is provided with a horizontally disposed planar top closure 54 in which is provided a centrally located opening 56 through which protrudes inlet end 14 of the elongated body member 12. The top closure 54 can be an integral part of this housing, as shown, or can be manufactured separately therefrom and subsequently attached as desired. Housing 30 can be cylindrical-shaped or of other cross-sectional shape so long as the shape of strut retaining member 50 is complementary. Opening 56 is desirably of circular shape, as shown, but need not be, as will be appreciated.

Surrounding elongated body member 12 adjacent top closure 54 is a member 58 which is provided with a horizontally disposed flange 60 extending perpendicularly outwardly from member 58. The top surface 62 of flange 60, which is planar, bears directly against the planar bottom surface of top closure 54 adjacent opening 56. Member 58 is an internally threaded bushing which mates with the external threads 16 on the outlet end 14 of body member 12. Thus body member 12 can be moved in rotary fashion relative to member 58 providing more or less force in reserve as desired through struts 40, 42 against strut retention number 50. This potential and critical force for the movement of the valve assembly from the closed position to the open position, as later more fully disclosed, results from the potential force in compression member 64, in this case a conventional spring washer, surrounding body member 12 and located between strut directing member 44 and member 58, in the compressed state.

In the open bottom 52 of housing 30 there is provided valve closure means 66 which, in this most preferred embodiment of the improved fire sprinkler head 10 of my invention, comprises in combination the sandwich structure of strut retaining member 50 laminated to heat conductive member 68 by the heat fusible alloy layer 70. As will be best seen by reference to FIG. 2, strut retaining member 50 is divided into two equal parts or halves 72, 74 along a dividing line 76, the reason for which will soon be disclosed. Nevertheless, in the sandwich construction shown, the two halves 72, 74 are held together and maintained secure as a unit, until the onset of a fire and the attainment of a predetermined ambient temperature by the layer of heat fusible alloy 70 and the heat conductive member 68 which bridges the two halves together. As shown in FIG. 2, projections 78, 80 are provided on strut retaining member 50 in opposition to one another along an imaginary diameter of that circular shaped member, which diameter is perpendicular to dividing line 76. These projections intrude into respective openings 82, 84 in the side wall 86 of housing 30 providing a means for securing valve closure means 66 to the housing 30 and closing off the bottom open end 52 thereof. As will be seen from the drawing, in particular FIGS. 1 and 3, heat conductive member 68 is of somewhat lesser diameter than strut retaining member 50 and, quite importantly, is free from contact with the inside wall of housing 30. It will be appreciated that, as earlier disclosed, these components of the valve closure means 66 need not be of circular shape. Their shape depends only on the cross-sectional shape of housing 30.

Figure 4:
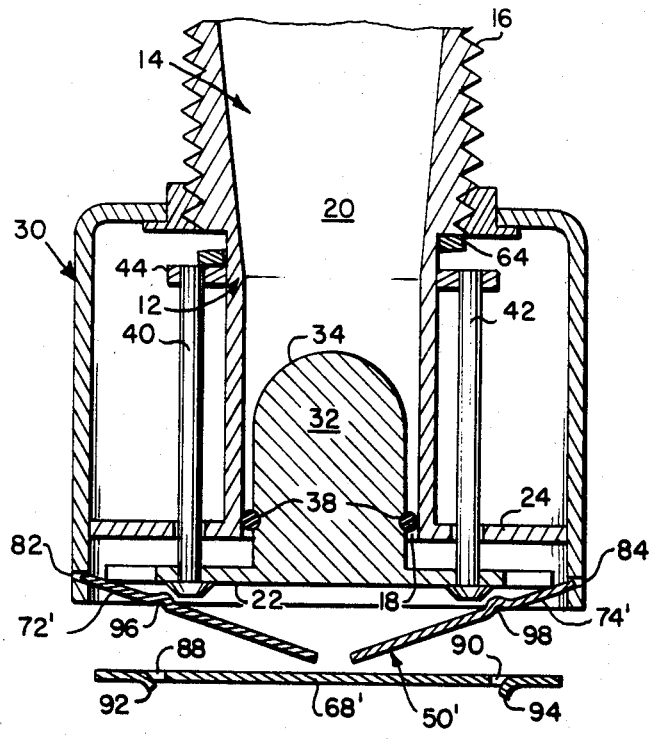
FIG. 4 is a view in cross-section of the fire sprinkler head shown in FIG. 1 with a modified valve closure means, and showing the valve assembly in the initial stage operating to the open position just after the heat fusible alloy has attained the predetermined melting temperature.

Turning now to FIG. 4 of the drawing, there is disclosed a further embodiment of a valve closure means in accordance with a preferred aspect of the invention. As shown therein, circular shaped openings, or windows, 88, 90 are provided in the heat conductive member 68' on opposite sides of the dividing line separating the two halves 72', 74' of that modified strut retaining member 50'. These windows can be provided, as shown, with downwardly, inwardly directed projecting, moon-shaped lips 92, 94 for aid in injecting liquid heat fusible alloy between heat conductive member 68' and the retaining member 50'. The halves 72', 74' of the strut retaining member are each provided with, as shown, a circular shaped upwardly extending dimple, as denoted by reference numerals 96, 98, for keying the heat fusible material and providing better adhesion between the strut retaining member 50' and heat conductive member 68'.

In the practice of the invention, it will be appreciated by those skilled in the art of fire sprinkler heads that the heat fusible alloy can be designed to melt at any temperature desired, generally in the range of about 135 degrees to 180° F. as is conventional in automatic sprinkler heads. The heat fusible alloy can be a low melting point solder, or other known eutectic compositions. The parts of the sprinkler head can be manufactured from metal commonly used for such purpose and can be made decorative, as desired, particularly in the case of the exposed heat conductive member which is exposed to view and flush with the ceiling. A major consideration is that the heat conductive member provide quick response in the automatic operation of the fire sprinkler head, in that it provide rapid transfer of temperature to the heat fusible layer. It will be appreciated that housing 30, if desired, can terminate in a collar or outwardly extending planar flange of decorative appearance which would be located flush against the ceiling.

Figure 5:
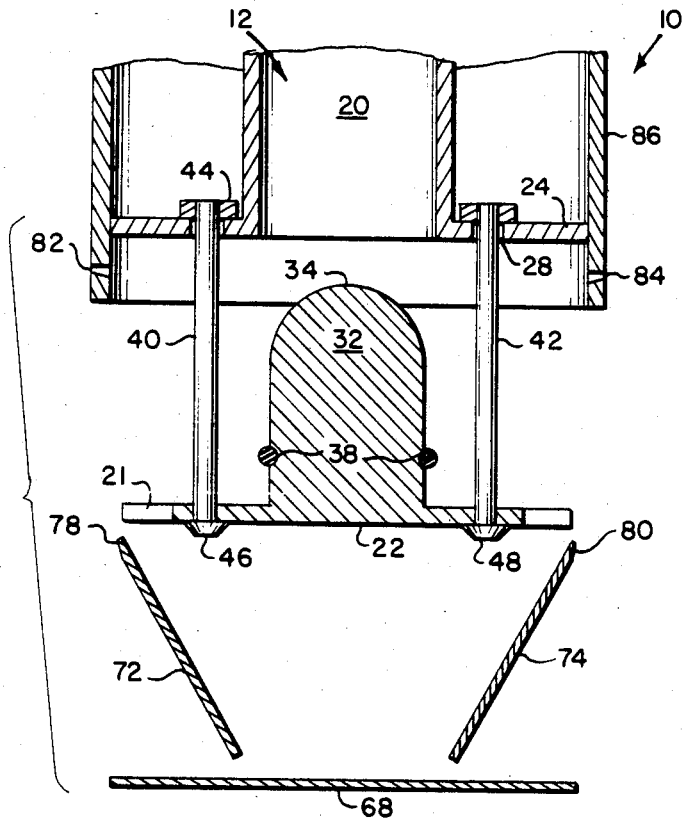
FIG. 5 is a partial view of the schematic sectional view of a fire sprinkler head, as shown in FIG. 1, showing the sprinkler head after reacting to the heat generated by a fire with the valve assembly in the full open position.

In operation, as will be appreciated more particularly by reference to FIGS. 4 and 5, with onset of a fire, the rise in the ambient temperature surrounding fire sprinkler head 10, and particularly the heat conductive member causes melting of the adjacent heat fusible alloy layer. This results in the heat conductive layer dropping away, as shown. When this occurs, the two halves of the strut retaining member, which are loosely secured together, if at all, at the dividing line, by any unmelted fusible alloy are the only means preventing the compressible member (which is in the compressed state) from expanding. The potential force in that compressed member overcomes any resistance offered by the strut retaining member, and the compressible member expands. This causes the force to be directed via the struts vertically downwardly against respective halves of the strut retaining member ensuring that this member falls away from the housing outlet, and freeing the valve assembly to move to the full open position, as is shown in FIG. 5. The struts, as will be appreciated, in combination with the force provided from the compressible member provides quick and positive response in the valve opening, as the heat fusible alloy proceeds toward its melting temperature. Thus, as the alloy begins to melt, the cohesive force therein weakens and full melting is not necessary to achieve release of the stored compressive force. The halves of the strut retaining member are caused to pivot downwardly, as shown, as these members are secured to the housing only by the projections or tabs 78, 80 extending into the respective openings 82, 84 in the housing side-wall. On movement of the valve assembly to the open position, valve body member 32 retracts from outlet end 18 allowing the fire extinguishing water to discharge directly downwardly onto deflector plate 22. This discharge is provided in the desired spray pattern onto the fire by teeth 21. When the fire is out, the valve assembly can then be pushed upwardly into the housing, at the same time compressing the compressible member. The halves of the strut retaining member are then positioned, followed by placement of the heat conductive member against the strut retaining member. The next step will depend somewhat on the form of heat fusible alloy being used and whether the valve closure means is that disclosed in FIG. 1, or in FIG. 4. The heat fusible alloy layer can be already provided on the heat conductive member, in which case the heat conductive member is merely positioned against the strut retaining member, heated to the desired degree and allowed to solidify, whereby the sandwich structure results. In case the valve closure means in FIG. 4 is used, molten alloy will be injected through the windows and allowed to solidify while the compressible member is held in compressed state. Thus, the fire sprinkler head of the invention is restored to the operative state without removal from the system.

It may be found more desirable, in some cases, to replace the fire sprinkler head after occurrence of a fire with a new sprinkler head, or one made operative at some remote location. The assembly of the valve closure means will ordinarily be found somewhat easier when working with an inverted housing positioned on a table or the like rather than from directly below, as in the case where the fire extinguisher head is already mounted in the ceiling.

Figure 6:
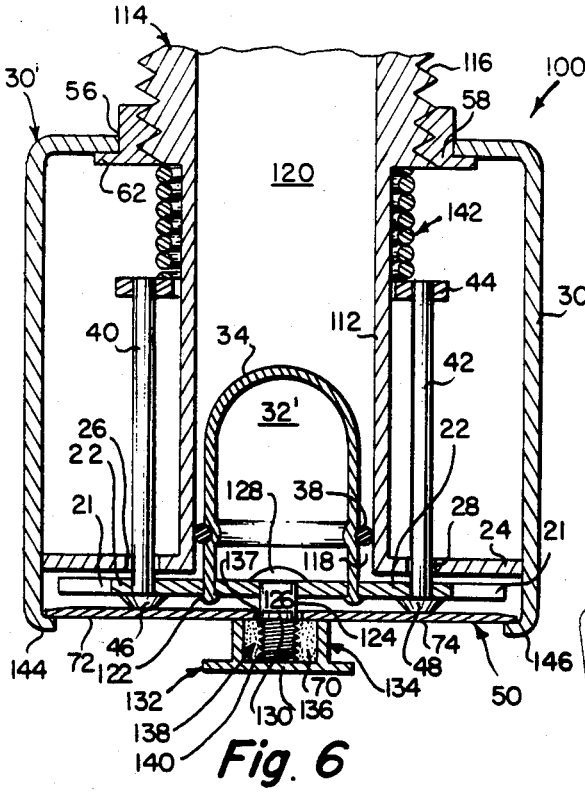
FIG. 6 is a schematic vertical cross-sectional view taken on a diameter of a further fire sprinkler head according to the invention.
Figure 8:
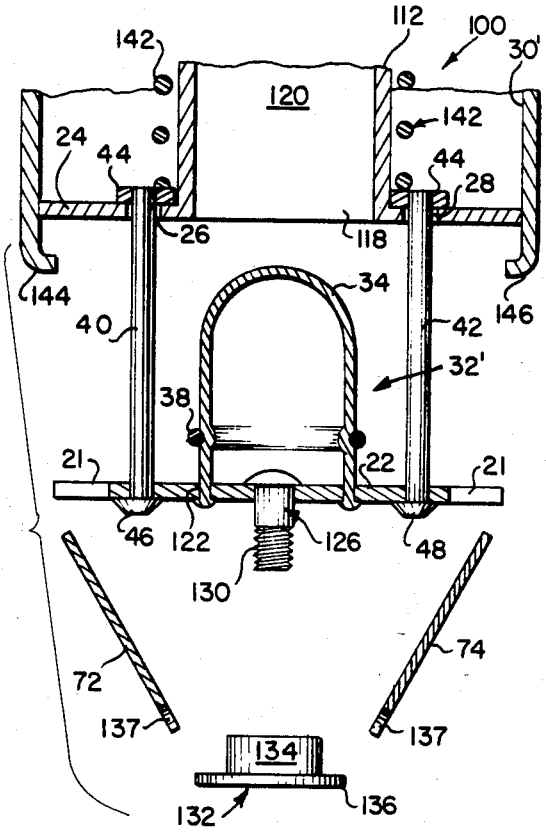
FIG. 8 is a partial view of the fire sprinkler head shown in FIG. 6 showing the valve assembly in the full open position.
Figure 7:
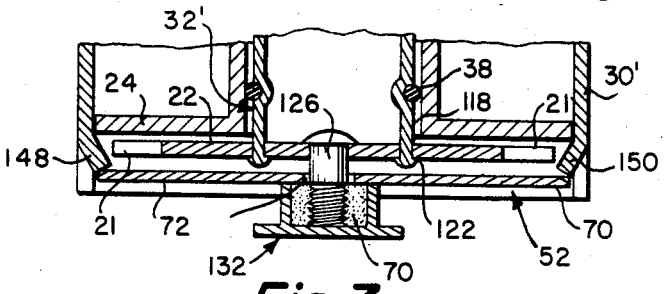
FIG. 7 is a fragmentary schematic, cross-sectional view of the sprinkler head shown in FIG. 6, taken on a diameter ninety degrees to that in FIG. 6.

Referring now to FIGS. 6–8, there is shown therein another embodiment of a fire sprinkler head 100 in accordance with the invention. Sprinkler head 100 differs from sprinkler head 10 in several important respects. As will be seen in FIG. 6, fire sprinkler head 100 comprises a vertically disposed centrally located body member 112 of cylindrical shape having an inlet end 114 and an outlet end 118, connected together by a central passageway 120. At inlet end 114 there are provided external threads 116 which mate with internal threads (not shown) provided on bushing 56. The threaded inlet end 114 provides a nipple whereby the sprinkler head 100 can be fastened to the internally threaded socket of a water line (not shown) according to conventional techniques. It will be appreciated, however, that if desired, outlet end 114 can be provided with internal threads for connection with an externally threaded nipple extending from the fire extinguishing system water line.

The valve assembly in sprinkler head 100 is provided with an elongated cylindrical shaped valve body member 32' open at the bottom thereof and closed at the top by a dome-shaped closure 34. The bottom of valve body member 32', as shown in FIG. 4, extends through a circular shaped opening 122 in deflector plate 22 and is permanently connected thereto as by welding, soldering, or the like. A centrally located circular-shaped opening 124 is provided within opening 122 in deflector plate 22 through which extends a lock pin 126 having a head 128 and a threaded shank 130, the purpose for which will later be more fully disclosed, if not already obvious. The half-sections 72, 74 of the strut retaining member 52 are held in horizontal disposition and against the ends 46, 48 of struts 40, 42 by heat conductive retainer or lock means 132. As shown, heat retainer means 132 comprises a cylindrical-shaped heat conductive body member 134 open at its top and closed at its bottom by a planar horizontally disposed circular-shaped heat conductive surface 136, of somewhat greater diameter. Thus, there is provided a relatively large surface area of relatively high heat conductive material for absorbing and transferring ambient heat in the event of a fire.

The cylindrical-shaped body member 134 is of somewhat larger diameter than the centrally located circular shaped opening 137 which is provided in strut retaining member 50. As will be appreciated, retainer means 132 provides a vessel for containing low melting heat fusible alloy 70 in which is provided a dead bore 138 with threads 140 therein for mating engagement with the threads on lock pin shank 130.

A compression spring 142, which surrounds the elongated body member 112, is provided between the strut directing member 44 and bushing 58 and, as shown in FIG. 6, is in the compressed state providing a desired potential force for rapidly moving the valve assembly from the closed position to the normally open position (FIG. 8). The movement of struts 40, 42 is in a reciprocal linear direction from the open to the closed position, or vice versa, vertically upwardly and downwardly, the struts being guided in this movement by the combination of the strut directing member 44 and openings 26, 28 in flange 24. As will be appreciated, compression spring 142 biases the assembly toward its normally open position, as shown in FIG. 8.

The half sections 72, 74 of circular-shaped strut retaining member 50 rest on, and are supported at their outer perimeter by inwardly extending support members or tabs 144, 146 at the bottom of housing 30'. These support or rest members are located in opposition to one another and on a diameter of the annular shaped housing. Housing 30' is provided with stops 148, 150 (FIG. 7) which extend inwardly in opposition to one another, the purpose for which will later be fully disclosed. These stops are provided on a diameter of housing 30' oriented ninety degrees to the diameter along which support members 144, 146 are located. Stops 148, 150 limit the movement vertically upwardly of the strut retaining member 50 and help provide that this member is maintained intact as a unit and in horizontal disposition when such is engaged by retainer means 132. The half sections 72, 74 are engaged by the respective projecting ends 46, 48 of struts 40, 42 at a point between dividing line 76 where the said sections are mated together along a diameter and the outer peripheral edge of the circular-shaped strut retaining member. In this way, the downward biasing force of the compression spring 142 against the body surrounding member 44 of the valve assembly is transmitted directly downwardly by the struts at each half-section of the strut retaining member 50. It will be appreciated that strut retaining member 50, like retainer means 132, can be of the same high heat conductive material.

The operation and advantages of this embodiment of the invention will be readily appreciated by reference to FIGS. 6 and 8 of the drawing. In FIG. 6, the sprinkler head 100 is shown in the closed or off position wherein valve assembly is held and maintained in that position until the onset of a fire and the attendant rise in ambient temperature, by the valve closure means comprising the combination of the strut retaining member and the heat responsive securing means. The compression spring 142, as a result, is in the compressed mode between the body surrounding member 44 and bushing 58 so that it creates a stored force which is directed vertically downwardly and against the valve assembly, hence against the valve securing means. In the closed position, valve body member 32' intrudes into passageway 120 at outlet end 118 and effectively seals that outlet so that fire extinguishing fluid is prevented from flowing through the passageway 120.

When a fire occurs in the surroundings where fire sprinkler head 100 is located, heat from the fire is absorbed by the heat conductive retainer means and is transferred to the low melting heat fusible alloy which melts when a predetermined temperature is reached, depending on the particular alloy composition used. As the alloy composition proceeds to melt, it provides less and less integrity as a means to hold the threaded lock pin and to provide a resistance to the downwardly directed force of the compression spring through the valve securing means. Thus the retainer means is caused to separate from the lock pin, falling away downwardly, as will be seen by reference to FIG. 8, while at the same time the compression spring expands to its uncompressed state. The downward force exerted by the compression spring acting through the spaced apart struts 40, 42 causes the respective half sections 72, 74 of the strut retaining means to pivot downwardly in opposite directions from one another as shown in the drawing. The projections or rests 144, 146, as will be appreciated, act to cause the half sections to pivot as described, as these rests offer the only resistance and support for the half sections against the downwardly directed force. On separation of the divided strut retaining member 50, no resistance is offered at all to expansion of compression spring 142 and it quickly expands while, at the same time, the valve assembly moves to the full open position. As soon as valve body member 32' retracts from outlet end 118, the fire extinguishing fluid, e.g. water, is free to flow through passageway 120 and to be discharged from the outlet end. The downward discharge of water is caused to radiate in the desired spray pattern on the fire as it hits deflector plate 22. The movement downwardly of the valve assembly is limited, as will be appreciated by reference to FIG. 8. Thus, flange 24 on the body member acts as a stop to further downward movement when contacted by the annular shaped body surrounding member 44. The length of struts 40, 42, taking into consideration the length of the body member, can be varied somewhat to provide the deflector plate at the desired location for the most effective spray pattern.

It will be appreciated that the greater the pressure behind the fire extinguisher fluid, the more such a fluid will, in and of itself, act in causing the valve assembly to retract to the open position. Nevertheless, the positive action on the valve assembly provided by the compressed spring results in reliable and quick response, even when the fire extinguishing fluid is under relatively low pressure. Thus, the time in which the fire extinguishing sprinkler head becomes operative is not only shortened, the operation of the sprinkler head to the open position is positive even at low fluid pressure.

The sprinkler head 100 of the invention is reset quite easily following a fire. This is accomplished by pushing the valve assembly back into housing 30' which, as will be appreciated, causes the compression of spring 142. The half sections of the strut retaining member are then positioned in the open end of the housing against the ends of struts 40, 42. These sections are supported at the bottom of their outer respective edges on rests 144, 146 and are prevented from moving vertically at the dividing line by stops 148, 150. Thus, the two half sections are provided in horizontal disposition and in a single plane. A retainer 132 is then threaded onto the lock pin 126 securing the two halves of the divided strut retaining member together at the dividing line and preventing their downward pivotal movement so long as the heat fusible alloy remains in the solid state. As will be appreciated, the valve closure means is the only part of the fire sprinkler head 100 that need be replaced, to restore the sprinkler head once again to operative condition. The length of the threaded bore in the retainer can vary somewhat so long as the open end thereof is in contact with the divided halves of the strut retainer member at the dividing line. The retainer should be capable of being screwed onto the lock pin more or less to provide the desired orientation of the mating half sections to one another in a horizontally disposed plane and to secure the half sections firmly together at the dividing line and against the downwardly directed force of the compression spring.

Figure 9:
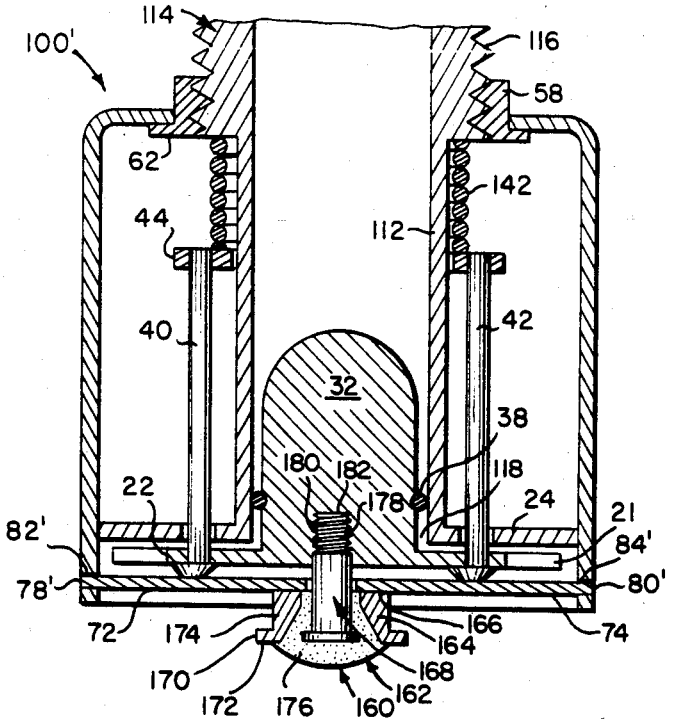
FIG. 9 is a schematic vertical, cross-sectional view taken on a diameter, of a further fire sprinkler head according to the invention.

A somewhat different embodiment of the invention is disclosed in FIG. 9. As shown therein, the means 160 for retaining the half sections 72, 74 of the strut retaining member together at the dividing line 76 is of different construction than that disclosed in FIGS. 6–8, and the manner of securing the strut retaining member at its outer peripheral edge to the housing differs somewhat; otherwise, the construction of the fire sprinkler head is the same, and like figures are used to identify the same components. The securing means 160 comprises a head 162 having an elongated rounded body member 164 terminating in a horizontally disposed planar surface 166 and an elongated lock pin 168, located centrally in said surface and extending perpendicularly therefrom. Head 162, as shown in FIG. 9, comprises an outer shell 170, of heat conductive material having a planar horizontally disposed outer surface 172 and a cylindrical shaped body member 174. Internally of the heat conductive shell 170 is provided a heat fusible alloy 176 in which is embedded one end of the lock pin 168. The other end is provided with external threads 178 which mate with internal threads 180 provided in dead bore 182 located centrally in the base of valve body member 32. Thus, when securing means 160 is screwed into the valve body member (and into and through deflector plate 22) the half sections 72, 74 of the strut remaining member will be secured and maintained together at the dividing line.

With the onset of a fire and the rise in ambient temperature surrounding securing means 160, the heat conductive shell will absorb and transmit heat to the heat fusible alloy composition. As the alloy composition melts, the integrity of that composition deteriorates and the head 162 detaches from lock pin 168. As a result, no resistance is provided against expansion of the compressed spring 142, and the valve assembly moves rapidly to the open position, as earlier disclosed.

The outer peripheral edges of the half sections 72, 74 are provided with projections 82', 84' which extend into respective openings 78', 80' as disclosed previously with respect to the most preferred embodiment of the invention shown in FIGS. 1–3. As will be appreciated, however, stops 148, 150 (not shown) are provided in each embodiment of the invention herein disclosed, on a diameter oriented 90° with respect to the projections from the peripheral edges of the strut retaining members.

Figure 10:
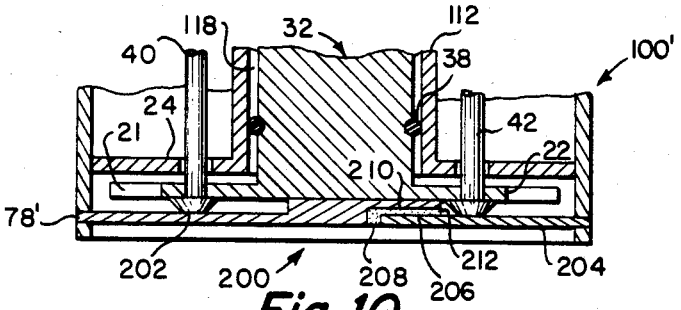
FIG. 10 is a schematic, vertical, cross-sectional view, taken on a diameter of a still further embodiment of a sprinkler head according to the invention.
Figure 11:
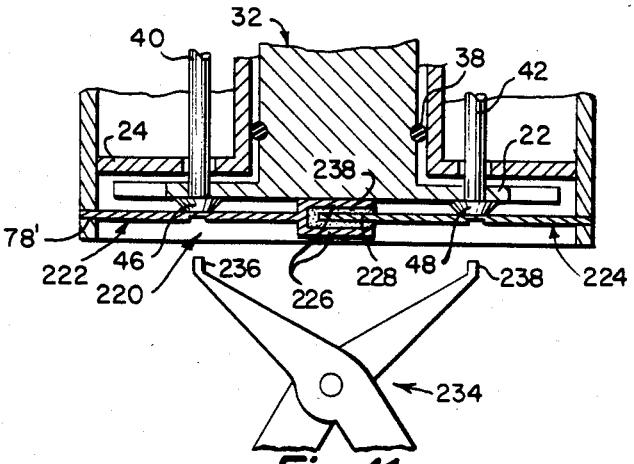
FIG. 11 is a schematic, vertical, cross sectional view, taken on a diameter of a still further embodiment of a fire sprinkler head in accordance with the invention disclosed herein.

Other further embodiments of the invention are shown in FIGS. 10 and 11. These embodiments of the fire sprinkler head invention are somewhat similar in construction to that embodiment shown in FIG. 9, except that the strut remaining member is of a different construction in each. As shown in FIG. 10, the disc-shaped strut retaining member 200 comprises a first overlapping section 202 and a second overlapping section 204 joined together by a heat fusible alloy composition 206. The overlapping sections mate together at dividing line 208, extending diametrically across the strut retaining member and provide a planar surface exposed to view in the open end of the housing 100'. As will be appreciated from FIG. 10, only section 202 is provided with an overlapping portion, that overlapping portion 210 terminating in a linear edge 212 parallel to the imaginary diameter in section 202 which coincides with dividing line 208. Nevertheless, if desired, both sections can be provided with overlapping portions, these overlapping portions each extending in opposite directions a predetermined distance from an imaginary diameter of the strut retaining member and terminating in edges parallel to one another and to the imaginary diameter. Thus, when a fire occurs in the vicinity of the sprinkler head, heat from the fire will be absorbed by the two strut retaining member sections of heat conductive material and transmitted to the heat fusible alloy layer. This layer will melt, causing separation of the two sections in the overlapping portion whereby no further resistance is offered to the expansion of the compressed compression spring 142. The expansion of this spring causes the valve assembly to rapidly move to the full open position.

In FIG. 11, a further modification in the strut retaining member is disclosed. As shown therein, strut retaining member 220 comprises a first section 222 and a second section 224 which mate together along an imaginary diameter thereof in tongue and groove fashion. The groove 226 can be provided on either section desired and extends along the entire edge defined by a diameter of the strut retaining member. The tongue 228 is embedded in heat fusible alloy 238 extending the length of the groove 226. On the occurrence of a fire, the heat fusible alloy will melt when a predetermined ambient temperature is reached surrounding the fire sprinkler head, in particular, the heat conductive strut retaining member. The area offered by that portion of the groove exposed to the heat from the fire provides good heat absorption and transfer to the heat fusible alloy composition. Thus, the composition quickly reaches melting temperature and the downward force of the compressed compression spring 142 rapidly overcomes any force resisting expansion, resulting in separation of the tongue 228 from the groove 226 and the two divided sections of the strut retaining member to be pushed away and downwards from the housing bottom.

In resetting the fire sprinkler head of this embodiment of the invention, use will be made of tool 234 shown just below the sprinkler head in FIG. 11, and which functions somewhat in the manner of a pair of scissors. Once the valve assembly is moved to the closed position, sections 222 and 224 will be assembled at their inner edges in tongue and groove fashion and at their outer peripheral edges in the housing. The ends 236, 238 of tool 234 are then inserted in circular shaped openings located on a diameter of the strut retaining member on each side of the line dividing the two sections. The tool is then operated to cause the two sections to separate from one another in a horizontally disposed plane while at the same time a liquid heat fusible alloy composition is injected into the groove. When the alloy composition hardens the tool is then removed.

Other modifications and changes, as will be understood, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and fixtures shown and described herein, but it is desired to include all such as properly come within the spirit and scope of the invention disclosed.

What I claim is:

1. Fire sprinkler head suitable for mounting in a concealed position in the ceiling in a residential dwelling comprising an elongated body member having an inlet end to be connected to a water line and an outlet end for discharge of water onto a fire, a central passageway in said body member connecting said inlet end to said outlet end, an outwardly extending flange at said outlet end integral with and surrounding the said body member, two spaced-apart openings being provided in said flange located on an imaginary line and on opposite sides of said body member, an elongated housing for said elongated body member open at the bottom end thereof and provided with a horizontally disposed, planar top closure at the top end, a centrally located opening in said top closure through which said inlet end of said body member extends, a member surrounding said elongated body member having an outwardly extending flange extending around the outer periphery thereof and of somewhat greater dimension than said opening in said top closure, said outwardly extending flange being in contact with and pressing against the underside of said top closure, a valve assembly automatically operable to an open position from a closed position at a predetermined ambient temperature comprising a horizontally disposed circular-shaped deflector plate located adjacent to and beneath said outwardly extending flange on said body member, a plurality of horizontally extending teeth being provided uniformly and in spaced-apart location around the circumference of said circular-shaped deflector plate, a valve body member located centrally on and supported by said deflector plate which, when the valve assembly is in its closed position, intrudes into said outlet end, means being located on said valve body member for providing positive seal of said outlet end when the said valve assembly is in the closed position, a strut directing member surrounding said body member and capable of reciprocal linear movement up and down along a predetermined portion of the length of said body member, two spaced-apart vertically disposed struts connected to said strut directing member at their top ends on a line that coincides with the line on which said two spaced-apart openings are located, said struts each extending through respective said spaced-apart openings and being connected at their bottom ends to said deflector plate and each extending a predetermined equal distance there beyond, a compressible member surrounding said elongated body member and being located between said outwardly extending flange on said body surrounding member and said strut directing member and a valve closure means located in the open bottom end of said housing for maintaining the compressible member in the compressed mode and the valve assembly in the closed position comprising a horizontally disposed strut retaining member divided into two sections along a dividing line therefor, the said strut retaining member being so oriented with respect to the imaginary line along which said spaced apart openings in said flange are located that the dividing line of said strut retaining member is perpendicular thereto, and means responsive to heat for maintaining and securing the two sections of the said strut retaining member intact as a unit until the onset of a fire and the attainment of a predetermined ambient temperature surrounding the fire sprinkler head whereby until the onset of a fire and the attainment of said temperature said compressible member is maintained in the compressed mode and the bottom ends of each said strut bears directly against the respective half sections of the said strut retaining member under a positive force.

2. Fire sprinkler head suitable for mounting in a concealed position in the ceiling in a residential dwelling according to claim 1 wherein the said strut retaining member is of a planar shape, and the said heat responsive securing means in said valve closure means comprises in combination a planar, horizontally disposed heat conductive member of somewhat lesser dimension than said strut retaining member and a layer of heat fusible alloy, and said heat conductive member is laminated to said divided strut retaining member by said heat fusible alloy.

3. Fire sprinkler head suitable for mounting in a concealed position in the ceiling in a residential dwelling according to claim 2 wherein openings are provided in said heat conductive member in spaced-apart locations on opposite sides of the dividing line in said divided strut retaining member whereby said heat fusible alloy layer can be introduced in liquid state between said heat conductive member and said strut retaining member.

4. Fire sprinkler head suitable for mounting in a concealed position in the ceiling in a residential dwelling according to claim 3 wherein a conical-shaped dimple is provided in each divided section of the strut retaining member in opposition to respective said openings in the heat conductive layer whereby means are provided for providing better adhesion between the alloy layer and the strut retaining member through mechanically interlocking the layers together at the said dimples.

5. Fire sprinkler head suitable for mounting in a concealed position in the ceiling in a residential dwelling according to claim 1 wherein the central passageway in said elongated body member is of a cylindrical shape.

6. Fire sprinkler head suitable for mounting in a concealed position in the ceiling in a residential dwelling according to claim 1 wherein the central passageway in the said body member at the inlet end is in the shape of an inverted truncated cone and at the outlet end is of cyclindrical shape.

7. Fire sprinkler head suitable for mounting in a concealed position in the ceiling in a residential dwelling according to claim 1 wherein the said valve body member is of elongated circular shape and an o-ring member is provided thereon and surrounds said valve body member for providing a positive seal when the said valve assembly is in the closed position.

8. Fire sprinkler head suitable for mounting in a concealed position in the ceiling in a residential dwelling according to claim 1 wherein said strut retaining member is planar and a centrally located opening is provided in said strut retaining member bridging the line dividing the two sections thereof, and screw threads are provided centrally in said deflector plate and extending into the base of the said valve body member a predetermined distance in direct alignment with said centrally located opening, and said heat responsive securing means comprises in combination a locking pin having a head comprising a heat fusible alloy and having a body member with a planar surface for placement in direct engagement against said strut retaining member, and a shank embedded in said alloy with threads thereon for engagement with the threads in said valve body member whereby when the locking pin is screwed into the valve body member the two sections of the strut retaining member will be secured together and maintained intact as a unit whereby resistance is offered to movement of the valve assembly.

9. Fire sprinkler head suitable for mounting in a concealed position in the ceiling in a residential dwelling according to claim 1 wherein said strut retaining member is planar and a centrally located opening is provided in the strut retaining member which bridges the said dividing line, the valve body member is of cylindrical shape having a dome shaped closure at the top end and is open at the bottom end, and said heat responsive securing means comprises a lock pin having a shank with threads thereon extending vertically downwardly from said deflector plate and through the centrally located opening in the strut retaining member, and a retainer for combination with said lock pin having a planar surface for location directly against said strut retaining member comprising heat fusible alloy and screw threads are provided in said heat fusible alloy for screwing said retainer on the said threaded shank whereby the two sections of the said strut retaining member are maintained intact and together as a unit.

10. Fire sprinkler head suitable for mounting in a concealed position in the ceiling in a residential dwelling according to claim 1 wherein the said flange at the outlet end of the elongated body member is annular shaped.

11. Fire sprinkler head suitable for mounting in a concealed position in the ceiling in a residential dwelling according to claim 10 wherein said housing is cylindrical-shaped and said outwardly extending flange on said body member is connected at its outer edge to said housing.

12. Fire sprinkler head suitable for mounting in a concealed position in the ceiling in a residential dwelling according to claim 11 wherein the said strut retaining member in said valve closure means is circular shaped and of only slightly lesser internal diameter than said housing.

13. Fire sprinkler head suitable for mounting in a concealed position in the ceiling in a residential dwelling according to claim 12 wherein the said heat responsive securing means comprises a circular-shaped heat conductive member co-extensive in diameter to the strut retaining member.

14. Fire sprinkler head suitable for mounting in a concealed position in the ceiling in a residential dwelling according to claim 1 wherein a tab is provided on each said section of the strut retaining member which extends horizontally outwardly therefrom, said tabs being in opposition to one another and lying on a diameter intersecting said dividing line at a ninety degree angle thereto, and opposed openings are provided in said housing at said outlet end for location of said tabs.

15. Fire sprinkler head suitable for mounting in a concealed position in the ceiling in a residential dwelling according to claim 1 wherein rests are provided on said housing in opposition to one another and on a line intersecting and perpendicular to said dividing line whereby the peripheral edge of each said section of the divided strut retaining member is supported in horizontal disposition.

16. Fire sprinkler head suitable for mounting in a concealed position in the ceiling in a residential dwelling according to claim 1 wherein stop members are provided in opposition to one another on said housing and in alignment with the line dividing the two sections of the strut retaining member whereby the vertical upward movement of the said strut retaining member is limited.

17. Fire sprinkler head suitable for mounting in a concealed position in the ceiling in a residential dwelling according to claim 1 wherein the bottom end of each said strut terminates in the shape of an inverted cone whereby each strut is in a point contact with respective sections of the strut retaining member.

18. Fire sprinkler head suitable for mounting in a concealed position in the ceiling in a residential dwelling according to claim 1 wherein at least one of the sections of the said strut retaining member is provided with an inner edge that overlaps the other at the dividing line and the said heat responsive means comprises a heat fusible alloy and said overlapped edge is laminated to the other section overlapped by said heat fusible alloy.

19. Fire sprinkler head suitable for mounting in a concealed position in the ceiling in a residential dwelling according to claim 1 wherein a groove is provided in the inner edge of one section of the strut retaining member and the inner edge of the other section is provided with a tongue whereby the two sections of the strut retaining member are joined together at the dividing line in tongue and groove fashion, and the said heat responsive means comprises a heat fusible alloy located in the groove that joins the two sections temporarily together until the onset of a fire and the rise in ambient temperature.

20. Fire sprinkler head suitable for mounting in a concealed position in the ceiling in a residential dwelling according to claim 1 wherein said elongated body is of tubular shape and the inlet end thereof is provided with external screw threads, and said member surrounding the elongated body member at the inlet end is an internally threaded bushing provided with means protruding through said top housing opening whereby the bushing can be turned on the said elongated body member.

21. Fire sprinkler head suitable for mounting in a concealed position in the ceiling in a residential dwelling according to claim 20 wherein said top housing opening is of a circular shape and said outwardly extending flange on said bushing is also of a circular shape but of somewhat larger diameter.

* * * * *